US010937619B2

(12) United States Patent
Yoneda et al.

(10) Patent No.: US 10,937,619 B2
(45) Date of Patent: Mar. 2, 2021

(54) FUSE ELEMENT AND FUSE DEVICE

(71) Applicant: DEXERIALS CORPORATION, Tokyo (JP)

(72) Inventors: Yoshihiro Yoneda, Utsunomiya (JP); Kazuaki Suzuki, Kanuma (JP)

(73) Assignee: DEXERIALS CORPORATION, Tokyo (JP)

( * ) Notice: Subject to any disclaimer, the term of this patent is extended or adjusted under 35 U.S.C. 154(b) by 257 days.

(21) Appl. No.: 14/903,542

(22) PCT Filed: Aug. 27, 2014

(86) PCT No.: PCT/JP2014/072351
§ 371 (c)(1),
(2) Date: Jan. 7, 2016

(87) PCT Pub. No.: WO2015/030023
PCT Pub. Date: Mar. 5, 2015

(65) Prior Publication Data

US 2016/0172143 A1 Jun. 16, 2016

(30) Foreign Application Priority Data

Aug. 28, 2013 (JP) ..... JP2013-177071
Aug. 14, 2014 (JP) ..... JP2014-165154

(51) Int. Cl.
*H01H 85/20* (2006.01)
*H01H 85/08* (2006.01)
(Continued)

(52) U.S. Cl.
CPC ..... *H01H 85/2045* (2013.01); *H01H 85/08* (2013.01); *H01H 85/143* (2013.01);
(Continued)

(58) Field of Classification Search
CPC ..... H01H 85/06; H01H 85/11; H01H 85/143; H01H 85/175; H01H 85/20;
(Continued)

(56) References Cited

U.S. PATENT DOCUMENTS 4,166,267 A * 8/1979 Belcher ..... H01H 85/055 337/163
4,599,596 A * 7/1986 Arikawa ..... H01H 85/0411 337/201
(Continued)

FOREIGN PATENT DOCUMENTS

JP 2002-319345 A 10/2002
JP 2009-076330 A 4/2009
(Continued)

OTHER PUBLICATIONS

Sep. 30, 2014 Search Report issued in International Patent Application No. PCT/JP2014/072351.
(Continued)

*Primary Examiner* — Jacob R Crum
(74) *Attorney, Agent, or Firm* — Oliff PLC

(57) ABSTRACT

A fuse device that uses a fuse element having an appropriate size in order to improve the rating, while maintaining insulation performance. The fuse device is provided with a fuse element, a case having a housing space for housing the fuse element and having a lead-out port through which both ends of the fuse element are led out, and which supports the fuse element in a bridge-like manner in the housing space; and a shield disposed in the housing space for shielding an inner wall surface leading to the lead-out port from a scattered melted material from a fusing location of the fuse element.

28 Claims, 14 Drawing Sheets

(51) Int. Cl.

| | |
|---|---|
| ***H01H 85/143*** | (2006.01) |
| *H01H 85/041* | (2006.01) |
| *H01H 85/175* | (2006.01) |
| *H01H 85/00* | (2006.01) |
| *H01H 85/06* | (2006.01) |

(52) U.S. Cl.
CPC ..... *H01H 85/20* (2013.01); *H01H 85/06* (2013.01); *H01H 85/175* (2013.01); *H01H 2085/0034* (2013.01); *H01H 2085/0414* (2013.01)

(58) Field of Classification Search
CPC ..... H01H 85/2045; H01H 2085/381; H01H 2085/383; H01H 2085/0414
USPC ..... 337/186, 193, 290, 295, 416
See application file for complete search history.

(56) References Cited

U.S. PATENT DOCUMENTS 4,894,633 A * 1/1990 Holtfreter ..... H01H 85/0411 337/201
6,452,474 B1 * 9/2002 Oh ..... H01H 85/0417 337/186
2005/0040926 A1 * 2/2005 Ely ..... H01H 85/11 337/159
2006/0066436 A1 * 3/2006 Langhoff ..... H01H 85/08 337/187
2006/0214259 A1 * 9/2006 Spaunhorst ..... H01H 69/022 257/529
2009/0027155 A1 * 1/2009 Arikawa ..... H01H 85/38 337/228
2010/0066477 A1 * 3/2010 Whitney ..... H01H 85/0073 337/290
2010/0176910 A1 * 7/2010 Knab ..... H01H 37/761 337/290
2010/0328020 A1 12/2010 Wiryana et al.
2012/0133478 A1 * 5/2012 Chiu ..... H01H 85/165 337/228

FOREIGN PATENT DOCUMENTS

JP 2011-009222 A 1/2011
KR 10-2009-0031280 A 3/2009

OTHER PUBLICATIONS

Aug. 21, 2020 Office Action issued in Korean Patent Application No. 10-2016-7004775.

* cited by examiner

FUSE ELEMENT AND FUSE DEVICE

TECHNICAL FIELD

The present invention relates to a fuse element and a fuse device mounted on a current path blown by self-generated heat when a rate-exceeding current flows therethrough, thereby interrupting the current path, and more particularly relates to a fuse element having excellent high-speed blowout properties and a fuse device having excellent insulating properties after blowout. This application claims priority to Japanese Patent Application No. 2013-177071 filed on Aug. 28, 2013 and Japanese Patent Application No. 2014-165154 filed on Aug. 14, 2014, the entire contents of which are hereby incorporated by reference.

BACKGROUND ART

Conventionally, there have been used fuse elements which are blown by self-generated heat when a rate-exceeding current flows therethrough to interrupt the current path. Examples of often-used fuse elements include, for example, fuses fixed by a holder wherein solder is enclosed in glass, chip fuses wherein an Ag electrode is printed onto a ceramic substrate surface, and screw-in or insertion type fuses wherein part of a copper electrode is made thinner and assembled into a plastic case.

Additionally, conventional fuse devices for high voltage applications include fuses having arc extinguishing material packed into a hollow case and fuses in which fuse elements are wrapped in a spiral around a heat dissipating material to generate a time lag.

CITATION LIST

Patent Literature

PLT 1: Japanese Unexamined Patent Application Publication No. 2002-319345

SUMMARY OF INVENTION

Technical Problem

In a fuse device using such a fuse element, due to a desire for increases in capacity and rating in target electronic appliances and batteries, improvements in current ratings are desired. Furthermore, due to a desire for smaller electronic appliances and batteries in which fuse devices are incorporated, smaller fuse devices are also desired.

In order to improve ratings in a fuse device, it is necessary to balance conductor resistance reduction with insulation properties when a current path is interrupted. Thus, in order to increase current flow, it is necessary to reduce conductor resistance; therefore, it is necessary to increase cross sectional area in the fuse element. However, as illustrated in FIGS. 19 (A) and (B), arc discharge generated when the circuit is interrupted scatters a metal body 80*a* constituting a fuse element 80 to the surroundings, and there is a risk that a current path 81 could be newly formed; increases in cross sectional area of a fuse element correspond to such a risk being increased.

Furthermore, conventional electrical fuses for high voltage application, such as those encapsulating arc extinguishing material or manufactured with a spiral fuse, require complicated materials and manufacturing processes, and are disadvantageous for decreasing size and increasing rating.

As described above, it is desired to develop a fuse device having a size sufficient for increasing rating while maintaining electrical insulation properties and having a simple structure which can enable size decrease and manufacturing simplification.

Solution to Problem

To solve the aforementioned problem, a fuse device according to the present invention includes: a fuse element; a case having a housing space for housing the fuse element and having a lead-out port through which both ends of the fuse element are led out, and which supports the fuse element in a bridge-like manner in the housing space; and a shield disposed in the housing space for shielding an inner wall surface leading to the lead-out port from a scattered melted material of the fuse element.

Furthermore, a fuse element according to the present invention, being supported in a bridge-like manner within a case and having both ends led out of a lead-out port of the case, includes a projecting section for shielding an inner wall surface of the case leading to the lead-out port from a scattered melted material.

Advantageous Effects of Invention

In the present invention, because the shield is provided in the housing space to interrupt the inner wall surface extending to the lead-out port, which supports the fuse element in a bridge-like manner, melted conductor is prevented from being continuously deposited on the inner wall surface leading to the lead-out port. Therefore, the present invention can prevent a state in which both ends of the melted fuse element are shorted by melted conductor of the fuse element being continuously deposited on the inner wall surface leading to the lead-out port.

DESCRIPTION OF EMBODIMENTS

Figure 1:
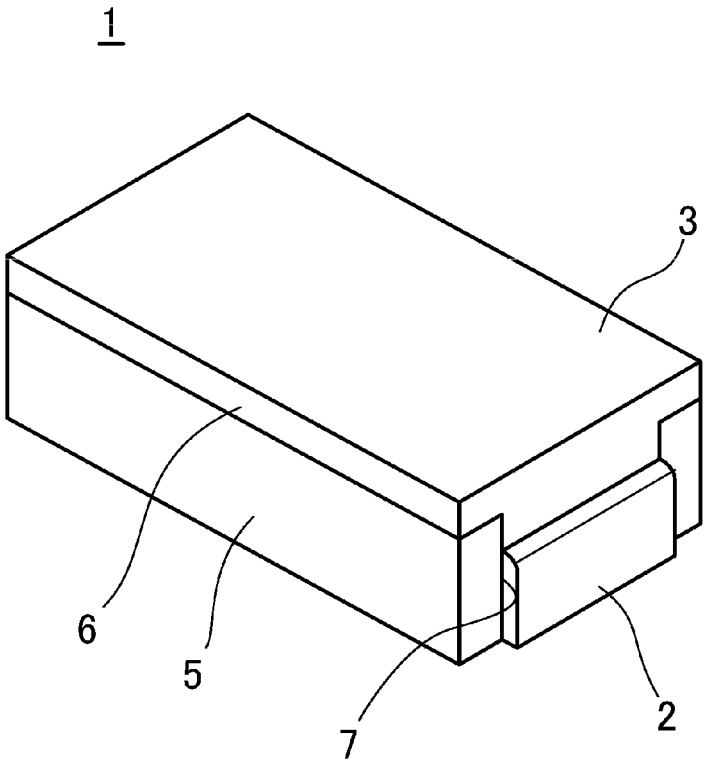
FIG. 1 is an external perspective view illustrating a fuse device according to the present invention.

The fuse element and the fuse device according to the present invention will now be more particularly described with reference to the accompanying drawings. It should be noted that the present invention is not limited to the embodiments described below and various modifications can be made without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

A fuse device 1 according to the present invention, as illustrated in FIG. 1, has a fuse element 2 and a case 3 for housing the fuse element 2. In the fuse device 1, both ends of the fuse element 2 are led out of a lead-out port 7 of the case 3 and are connected to terminals of a circuit in which the fuse device 1 is incorporated; the fuse device 1 thereby constitutes a portion of a current path of the circuit.

Fuse Element

The fuse element 2 is blown out by self-generated heat (Joule heat) when a rate exceeding current flows therethrough to interrupt the current path of the circuit into which the fuse device 1 is incorporated. Any metal which can be quickly melted by self-generated heat can be used in the fuse element 2, for example, a low melting point metal such as Pb-free solder having Sn as a primary constituent may be used.

Figure 2A:
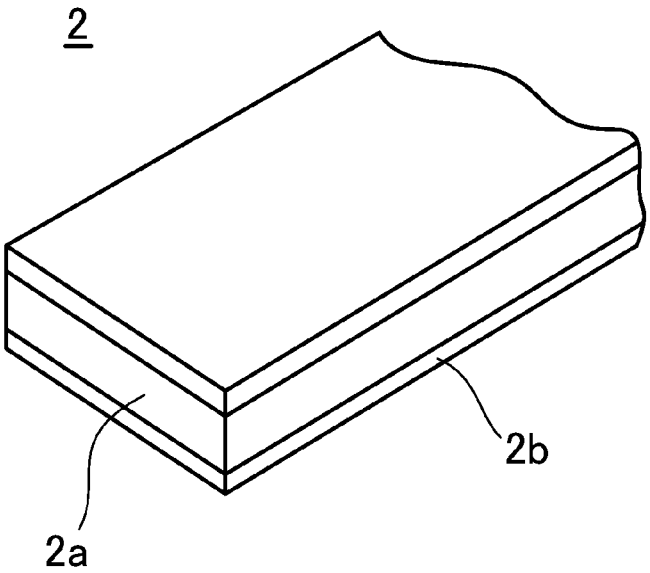
FIG. 2 is an external perspective view illustrating fuse elements in which (A) a high melting point metal layer is laminated on a low melting point metal layer and (B) a low melting point metal layer is covered by a high melting point metal layer.
Figure 2B:
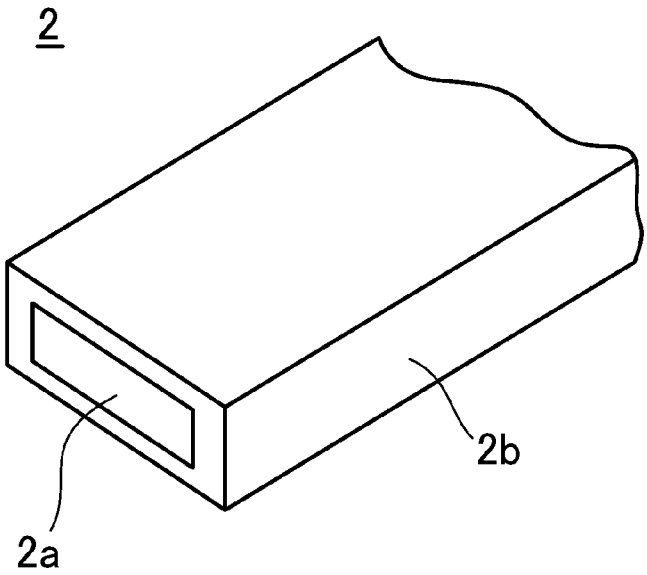

Additionally, the fuse element 2 may include a low melting point metal and a high melting point metal. For example, as shown in FIG. 2, the fuse element 2 has a laminated structure having inner and outer layers with a low melting point metal layer 2*a* as the inner layer and a high melting point metal layer 2*b* as the outer layer laminated on the low melting point metal layer 2*a* (FIG. 2 (A)) or coated on the low melting point metal layer 2*a* (FIG. 2 (B)).

The low melting point metal layer 2*a* is preferably a metal having Sn as a primary constituent, or a material commonly known as "Pb-free solder". The melting point of the low melting point metal layer does not necessarily need to be higher than the temperature of a reflow oven and may have a melting point of approximately 200° C. The high melting point metal layer 2*b* is a metal layer laminated on the surface of the low melting point metal layer 2*a* and, for example, is Ag, Cu, or a metal having one of these as a primary constituent, and has a high melting point so as not to melt even in the case of mounting the fuse device 1 by using a reflow oven.

By laminating the high melting point metal layer 2*b* as an outer layer to the low melting point metal layer 2*a*, which is an inner layer, even in the case of reflow temperature exceeding the melting point of the low melting point metal layer 2*a*, the fuse element 2 is not blown out; furthermore, leakage of low melting point metal can be suppressed and the shape of the fuse element 2 can be maintained. Thus, the fuse device 1 can be efficiently mounted by reflow.

Furthermore, the fuse element 2 is not blown out by self-generated heat while a predetermined rated current flows therethrough. When a current exceeding the rating flows, the fuse element 2 melts and a current path of a circuit connected via the fuse device 1 is interrupted. At this time, in the fuse element 2, erosion of the high melting point metal layer 2*b* by the low melting point metal layer 2*a* causes the high melting point metal 2*b* layer to melt at a temperature lower than the melting point thereof. Therefore, the fuse element 2 can blow out rapidly by using erosive action of the low melting point metal layer 2*a* on the high melting point metal layer 2*b*.

Furthermore, because the fuse element 2 has a structure in which the high melting point metal layer 2*b* is laminated on the low melting point metal layer 2*a*, the melting temperature thereof can be significantly reduced from that of conventional fuses made of high melting point metal, such as chip fuses. Therefore, in comparison with fuses such as chip fuses of the same size, cross-sectional area can be increased and current rating can be significantly improved in the fuse element 2. Furthermore, the fuse element 2 can be made smaller and thinner than conventional chip fuses having the same rating, and has excellent rapid blowout properties.

Still further, the fuse element 2 can improve tolerance to surges (pulse tolerance), in which an abnormally high voltage is momentarily applied, in an electrical system in which the fuse device 1 is incorporated. For example, the fuse element 2 does not blow out even in the case of a current of 100 A flowing for a few milliseconds. This is because a large current flowing for a very short duration flows across the surface of a conductor (skin effect), and because the high melting point metal layer 2*b* comprising an Ag plating having a low resistance is provided as an outer layer in the fuse element 2, a current caused by a surge can be easily allowed to flow and blowout due to self-generated heat can be prevented. Therefore, the fuse element 2 can significantly improve surge tolerance in comparison to conventional fuses made from solder alloys.

Manufacturing Method

The fuse element 2 can be manufactured by using plating techniques to film-form the high melting point metal layer 2*b* on the surface of the low melting point metal layer 2*a*. For example, the fuse element 2 can be efficiently manufactured by plating Ag to a long solder foil which can be easily used by cutting according to size at the time of use.

Additionally, the fuse element 2 may be manufactured by bonding a low melting point metal foil and a high melting point metal foil together. For example, the fuse element 2 may be manufactured by pressing a rolled sheet of solder foil between two rolled sheets of Cu foil or Ag foil. In this case, a low melting point metal foil that is softer than the high melting point metal foil is preferably selected. Doing this allows for compensation of unevenness in thickness so that the low melting point metal foil and the high melting point metal foil can be bonded together without voids. In addition, because film thickness is reduced by pressing, the low melting point metal foil may be made thicker beforehand. It is preferable to cut ends off and reshape in cases of the low melting point metal foil protruding from ends of the fuse element due to pressing.

Additionally, in the fuse element 2, thin film-forming techniques such as vapor deposition and other known laminating techniques may be used to laminate the high melting point metal layer 2*b* onto the low melting point metal layer 2*a*.

Furthermore, in the fuse element 2, the low melting point metal layer 2*a* and the high melting point 2*b* may be formed in multiple alternating layers. In this case, either the low melting point metal layer 2*a* or the high melting point metal layer 2*b* may be the outermost layer.

Furthermore, in the fuse element 2, in cases of the high melting point metal layer 2*b* being the outermost layer, an additional antioxidation film may be formed on this outermost layer of the high melting point metal layer 2*b*. By covering the outermost layer of the high melting point metal layer 2*b* with an additional antioxidation film, for example, even in cases of the high melting point metal layer being a Cu plating or a Cu foil, Cu oxidation can be prevented. Therefore, by preventing situations in which Cu oxidation extends blowout time, the fuse element 2 can rapidly blow out.

Case

The case 3 housing the fuse element 2 comprises, for example, as illustrated in FIG. 1, an enclosure 5 having an open top and a cover 6 which covers the top of the enclosure 5. The case 3 has a lead-out port 7 through which both ends of the fuse element 2, which connect to terminals of a circuit on which the fuse device 1 is mounted, are led out to the exterior. The case 3 is sealed with the exception of the lead-out port 7, through which both ends of the fuse element 2 are led out, for preventing intrusion of foreign materials such as mounting-use solder into the enclosure 5. The case 3 can be formed by using a material, such as an engineering plastic, having electrical resistance, heat tolerance and corrosion resistance.

The case 3 is formed by placing the fuse element 2 into the enclosure 5 via the open top side and by sealing with the cover 6. In the case 3, by sealing the enclosure 5 with the cover 6, the lead-out port 7 for leading out the fuse element 2 is formed. By leading both ends out of the fuse element 2 through the lead-out port 7, the fuse element 2 is supported in a bridge-like manner in a housing space 8 in the case 3.

When a rate exceeding current flows through the fuse element 2, which is supported on both ends by the lead-out port 7, for example, portions thereof central in relation to the direction of current flow are melted by self-generated heat (Joule heat) to interrupt a current path of the circuit in which the fuse device 1 is incorporated.

Shield

In the fuse device 1, a shield 10 is provided within the housing space 8 of the case 3 to shield an inner wall surface 8*a* leading to the lead-out port 7 from scattered melted material of the fuse element 2. The shield 10 can be provided on the inner wall surface 8*a* of the case, the fuse element 2 or both.

First Embodiment

Figure 3:
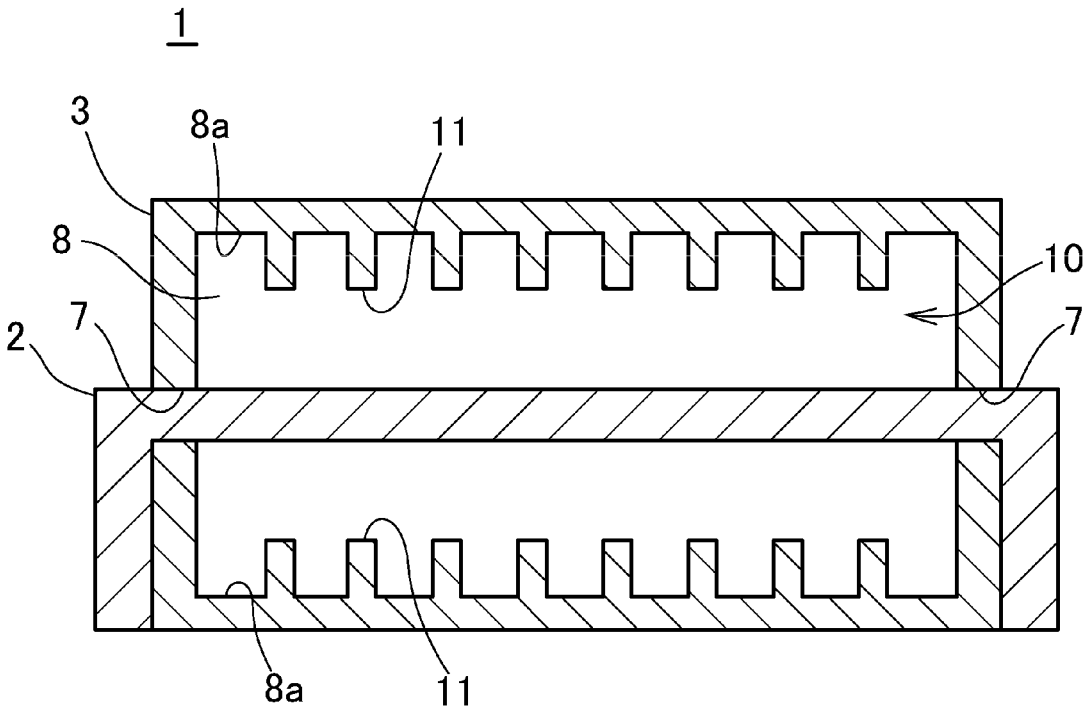
FIG. 3 is a cross-sectional view illustrating a fuse device having a shield comprising a projection provided on an inner wall surface of a case.
Figure 4:
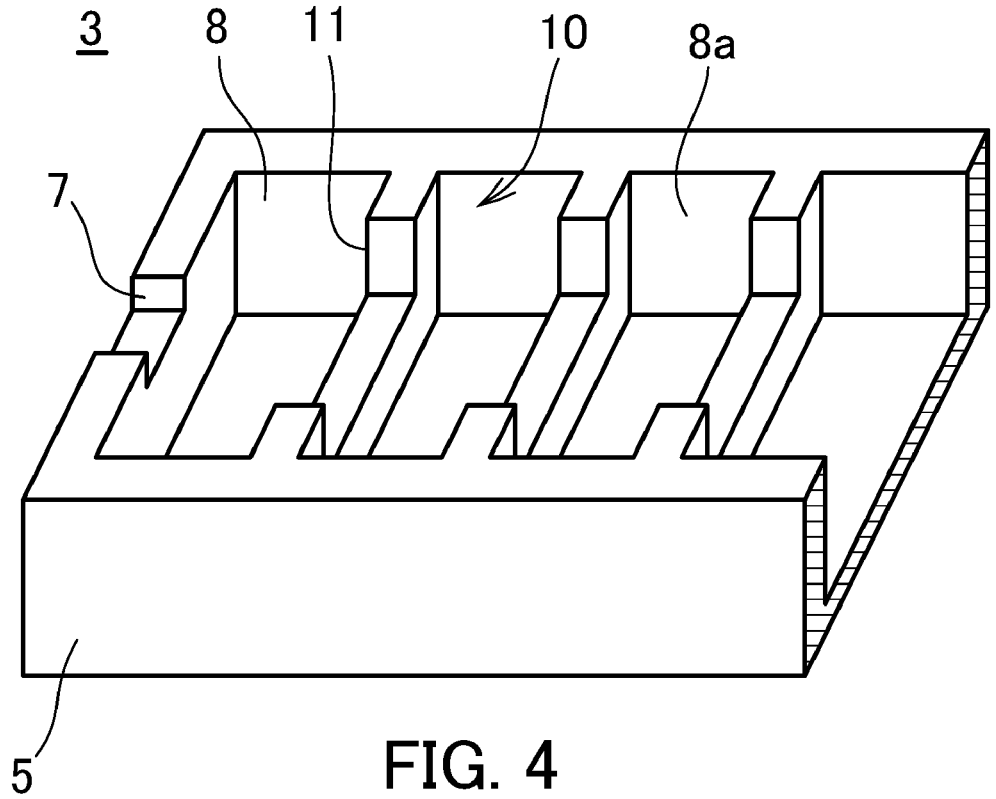
FIG. 4 is a perspective view illustrating the interior of a case enclosure of the fuse device illustrated in FIG. 3.

A shield 10 according to a first embodiment is a projection 11 provided on the inner wall surface 8*a* of the case 3 forming the housing space 8. As illustrated in FIGS. 3 and 4, the projection 11 is formed on the inner wall surface 8*a* of the case 3 perpendicular to the direction of current flow in the fuse element 2. Thus, the projection 11 is arranged to shield the inner wall surface 8*a* spanning between a pair of lead-out ports 7, 7 between which the fuse element 2 is supported in a bridge-like manner within the housing space 8.

Figure 5:
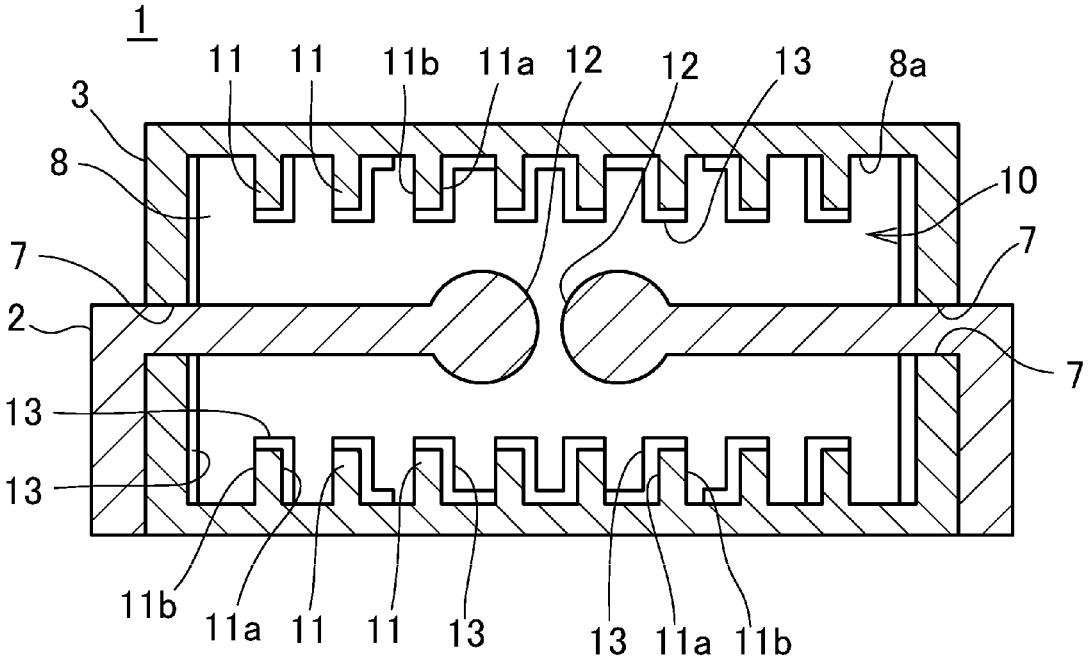
FIG. 5 is a cross-sectional view illustrating the fuse element of the fuse device illustrated in FIG. 3 in a melted state.

By doing this, as illustrated in FIG. 5, in the projection 11, a surface 11*a* faces a blowout location 12 of the fuse element 2 and an other surface 11*b* on an opposite side is blocked by the surface 11*a* and shielded from the blowout location 12. Therefore, in the fuse device 1, the fuse element 2 melts and, even in the case of a melted conductor 13 scattering to the inner wall surface 8*a* of the case 3, the melted conductor 13 is deposited on the surface 11*a* of the projection 11 and is not deposited on the other surface 11*b* which is blocked by the surface 11*a*.

Furthermore, within the housing space 8, because the projection 11 is situated so as to shield the inner wall surface 8*a* spanning between the pair of lead-out ports 7, 7 which support the fuse element 2 in a bridge-like manner, the melted conductor 13 can be prevented from being continuously deposited on the inner wall surface 8*a* spanning between the lead-out ports 7, 7. Therefore, the fuse device 1 can prevent a state in which both ends of the blown out fuse element 2 are short-circuited by the melted conductor 13 being continuously deposited on the inner wall surface 8*a* spanning between the lead-out ports 7, 7.

The projection 11 is preferably formed on the inner wall surface 8*a* so as to surround the entire perimeter of the fuse element 2. By forming the projection 11 so as to surround the entire perimeter, even in the case of the melted conductor 13 being scattered in all directions, the projection 11 shields the inner wall surface 8*a* spanning between the lead-out ports 7, 7 and short-circuiting of both ends of the blown out fuse element 2 can be prevented.

Additionally, the projection 11 is preferably formed in a location separated from the blowout location 12 of the fuse element 2. In the case of the projection 11 being formed in the vicinity of the blowout location 12, the other surface 11*b* is not adequately shielded by the surface 11*a* and the melted conductor 13 scattering from the blowout location 12 might be deposited thereon. Because the fuse element 2, in most cases, blows out in a central location with respect to the longitudinal direction, the projection 11 is preferably formed closer to the lead-out port 7 than the central location with respect to the longitudinal direction of the fuse element 2.

By doing this, in the projection 11, the melted conductor 13, scattering due to blowout of the fuse element 2, is deposited on the surface 11*a* which faces the blowout location 12 and is not deposited on the surface 11*b* which is on the back side of the surface 11*a*.

Furthermore, providing the projection 11 near the lead-out port 7 can assuredly prevent deposition of the melted conductor 13 on the other surface 11*b* and can prevent a state in which both ends of the blown out fuse element 2 are short-circuited by the melted conductor 13 being continuously deposited on the inner wall surface 8*a* spanning between the lead-out ports 7, 7.

Additionally, at least one of the projection 11 may be provided; however, as illustrated in FIGS. 3 and 4, a plurality of the projections 11 are preferably provided on the inner wall surface 8*a* of the case 3. By providing the plurality of the projections 11 on the inner wall surface 8*a* spanning between the lead-out ports 7, 7, even in the case of extensive scattering of the melted conductor 13, deposition of the melted conductor 13 onto the other surface 11*b* of the projection 11 can be assuredly prevented. With at least one of the projections 11, if deposition of the melted conductor 13 onto the other surface 11*b* is prevented, the melted conductor 13 can be prevented from being continuously deposited on the inner wall surface 8*a* spanning between the lead-out ports 7, 7, and a state in which both ends of the blown out fuse element 2 are short-circuited can be prevented.

Second Embodiment

Figure 6:
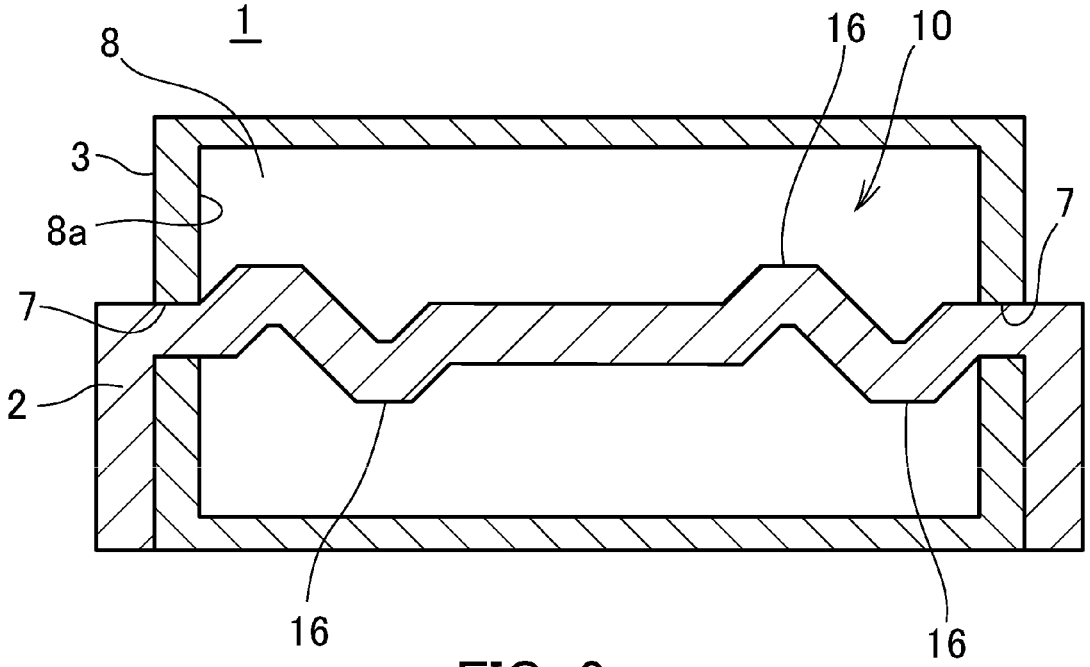
FIG. 6 is a cross-sectional view illustrating a fuse device having a shield comprising a projecting section provided on a fuse element.
Figure 7:
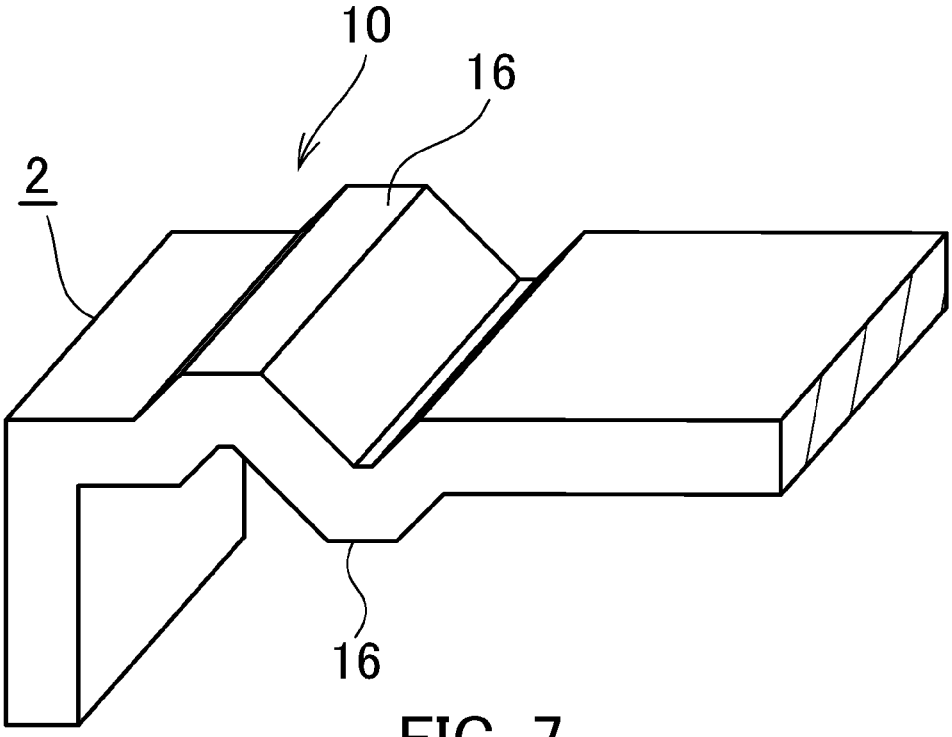
FIG. 7 is an external perspective view illustrating a fuse element provided in the fuse device illustrated in FIG. 6.

A shield 10 according to a second embodiment is a projecting section 16 provided on the fuse element 2. As illustrated in FIGS. 6 and 7, the projecting section 16 projects from the blowout location 12 of the fuse element 2 towards the inner wall surface 8*a* of the case 3 which is perpendicular to the direction of current flow. Thus, within the housing space 8, by the projecting section 16 protruding from the blowout location 12 of the fuse element 2, at least a portion of the inner wall surface 8*a* spanning between the lead-out ports 7, 7 of the case 3 are blocked by portions of the projecting section 16 shielded from the blowout location 12.

Figure 8:
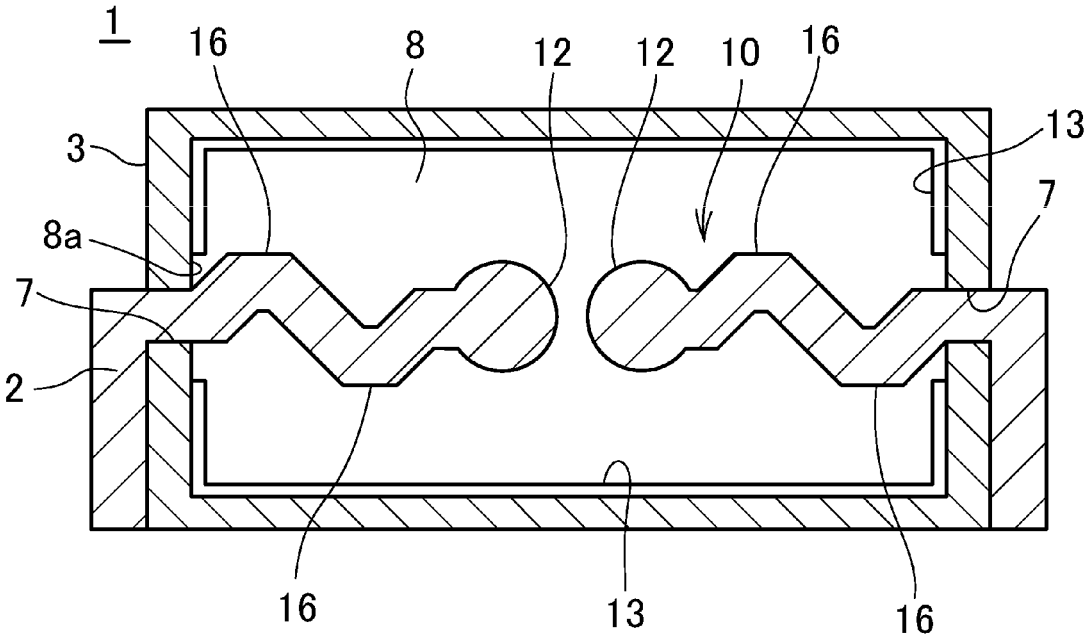
FIG. 8 is a cross-sectional view illustrating the fuse element of the fuse device illustrated in FIG. 6 in a melted state.

In so doing, as illustrated in FIG. 8, by the projecting section 16 protruding from the blowout location 12 of the fuse element 2, the inner wall surface 8*a* therebehind is blocked and thereby shielded from the blowout location 12. Therefore, in the fuse device 1, the fuse element 2 melts and, even in the case of the melted conductor 13 scattering towards the inner wall surface 8*a* of the case 3, the melted conductor 13 is deposited on the projecting section 16 and is not deposited on the inner wall surface 8*a* therebehind.

Furthermore, within the housing space 8, because the projecting section projects towards the inner wall surface 8*a* spanning between the pair of lead-out ports 7, 7 which support the fuse element 2 in a bridge-like manner, the melted conductor 13 can be prevented from being continuously deposited on the inner wall surface 8*a* spanning between the lead-out ports 7, 7. Therefore, in the fuse device 1, by preventing the melted conductor 13 from being continuously deposited on the inner wall surface 8*a* spanning between the lead-out ports 7, 7, a state in which both ends of the blown out fuse element 2 are short-circuited can be prevented.

Figure 9A:
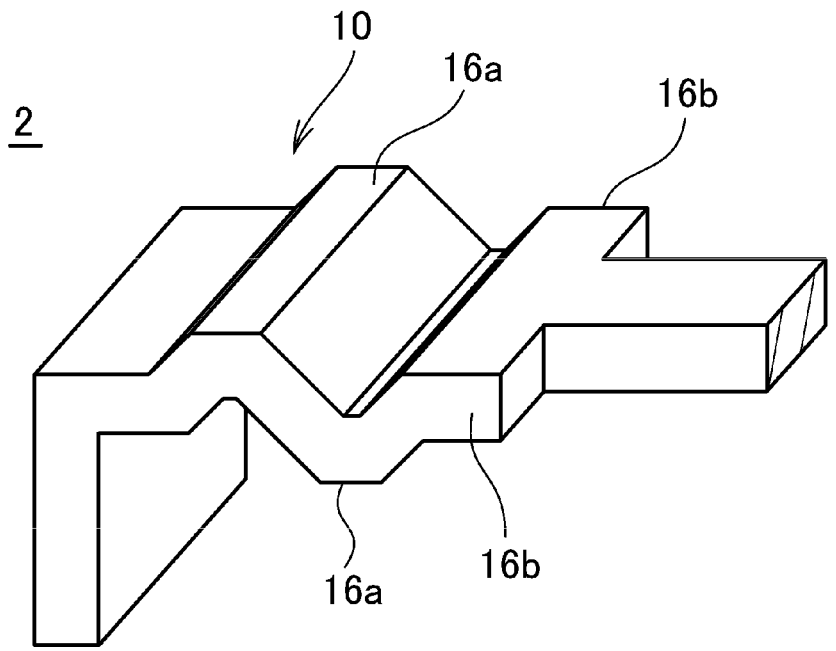
FIG. 9 illustrates a fuse element having a projecting section provided around the entire perimeter thereof in (A) an external perspective view and (B) a plan view.
Figure 9B:
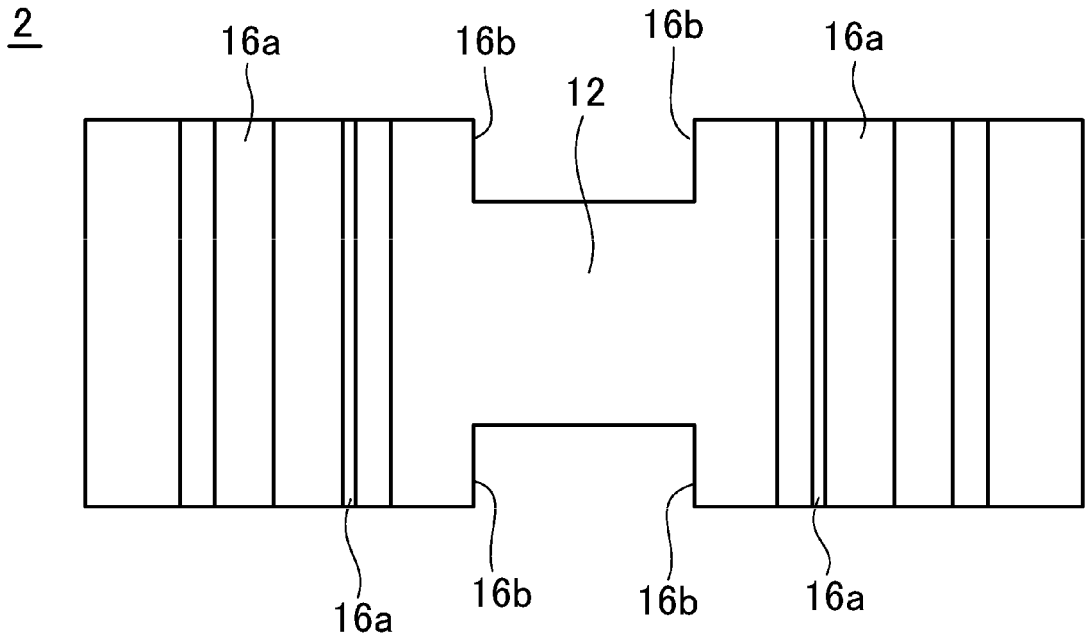

The projecting section 16, as illustrated in FIG. 9, is preferably provided around the entire perimeter of the fuse element 2. By providing the projecting section 16 around the entire perimeter, even in the cases of the melted conductor 13 being scattered in every direction, the inner wall surface 8*a* spanning between the lead-out ports 7, 7 is shielded, and a state in which both ends of the blown out fuse element 2 are short-circuited is prevented.

In the fuse element 2 illustrated in FIG. 9, by being bent up and down, a first projecting section 16*a* is formed in the vertical direction from the blowout location 12 (FIG. 9 (A)), and a second projecting section 16*b*, which is narrower than the projecting section 16*a* in a central region in the horizontal width direction, is formed to project from the blowout location 12 towards a side surface (FIG. 9 (B)); thus, the projecting section 16 is provided around the entire perimeter of the fuse element 2. Additionally, in the fuse element 2 illustrated in FIG. 9, the central portion narrowed in the width direction has a high resistance and is the blowout location 12 when a rate-exceeding current flows therethrough.

In addition, the projecting section 16, as in the projection 11, is preferably provided in a location separated from the blowout location 12 of the fuse element 2. In the case of the projecting section 16 being provided in the vicinity of the blowout location 12, the inner wall surface 8*a* of the case 3 is not adequately shielded from the blowout location and a short-circuit caused by scattering of the melted conductor 13 might occur between the lead-out ports 7, 7. Because the fuse element 2, in most cases, blows out in a central region with respect to the longitudinal direction, the projecting section 16 is preferably provided at a location nearer to the lead-out ports 7, 7 than the central region relative to the longitudinal direction of the fuse element 2.

By doing this, because the projecting section 16 protrudes in the direction in which the melted conductor 13 scatters from the fuse element 2, the melted conductor scattering from blowout of the fuse element 2 is deposited thereon and is prevented from being deposited on areas of the inner wall surface 8*a* blocked by the projecting section 16.

Furthermore, providing the projecting section 16 in the vicinity of the lead-out port 7 prevents the melted conductor 13 from being deposited in the vicinity of the lead-out port 7 and also prevents a state in which both ends of the blown out fuse element 2 are short-circuited by the melted conductor 13 being continuously deposited on the inner wall surface 8*a* spanning between the lead-out ports 7, 7.

Additionally, in the projecting section 16, a plurality of the first projecting sections 16*a* protruding vertically from the blowout location 12 of the fuse element 2 and the second projecting sections 16*b* protruding in the width direction from the blowout location 12 of the fuse element 2 may be formed. Forming the plurality of the projecting sections 16 ensures prevention of deposition of the melted conductor 13 onto portions of the inner wall surface 8*a* blocked by the projecting section 16, even in cases of the melted conductor 13 scattering widely. If continuous deposition of the melted conductor 13 between the lead-out ports 7, 7 is prevented by at least one projecting section 16, a state in which both ends of the blown out fuse element 2 are shorted can be prevented.

Third Embodiment

As a shield 10, the fuse device 1 may include both the above mentioned projection 11 provided on the inner wall surface 8*a* of the case 3 and the projecting section 16 provided on the fuse element 2.

Figure 10:
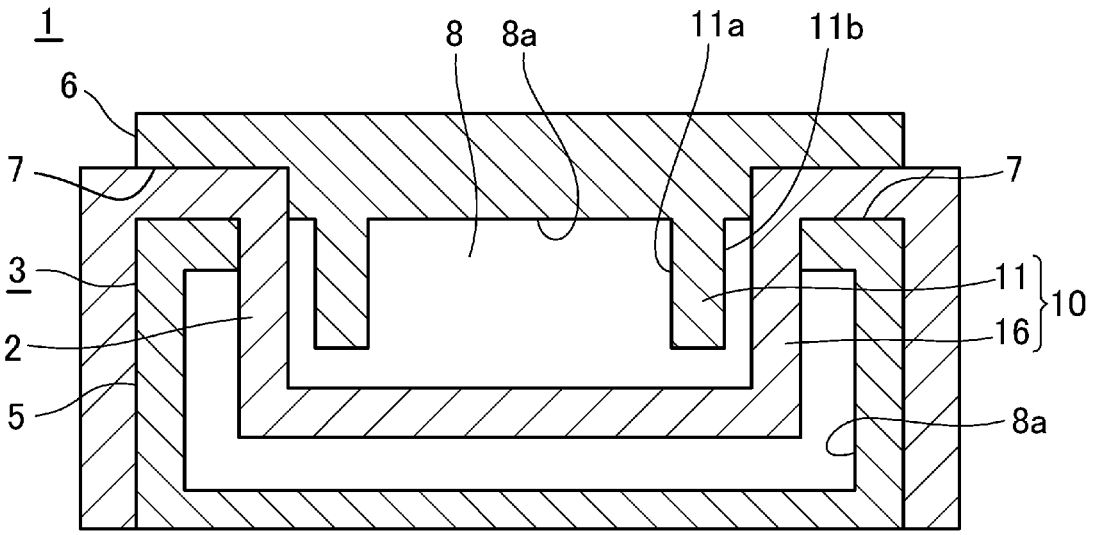
FIG. 10 is a cross-sectional view illustrating a fuse device having a projection provided on an inner wall surface of a case and a shield comprising a projecting section provided on a fuse element.
Figure 11:
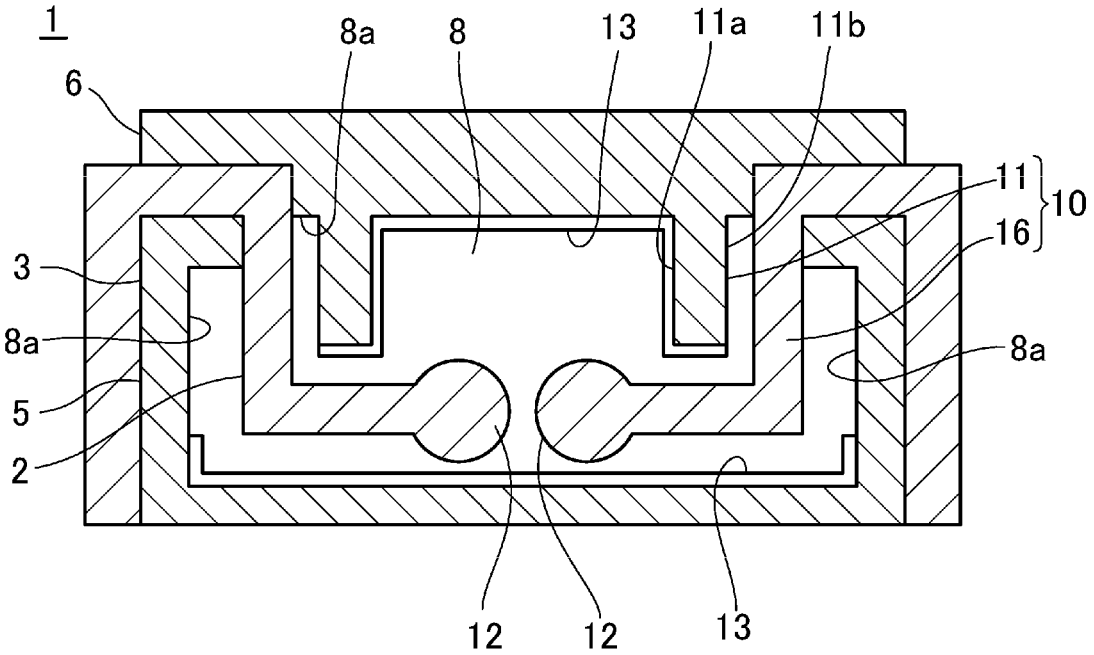
FIG. 11 is a cross-sectional view illustrating the fuse element of the fuse device illustrated in FIG. 10 in a melted state.

For example, as illustrated in FIGS. 10 and 11, the shield 10 is included both by providing a projection 11 on the cover 6 of the case 3 and by forming bends in the fuse element 2 on both sides thereof in the longitudinal direction on the lead-out port 7 sides so that a projecting section 16 protrudes upwardly from the blowout location 12.

The projection 11 is situated so as to shield the inner wall surface 8*a* on the side of the cover 6 spanning between the pair of lead-out ports 7, 7 which support the fuse element 2 in a bridge-like manner. The projection 11 has a surface 11*a* which faces the blowout location 12 of the fuse element 2 and an other surface 11*b* on the opposite side which is blocked by the surface 11*a* and thereby shielded from the blowout location 12. Therefore, as illustrated in FIG. 11, in the fuse device 1, the fuse element 2 blows out, and even in the case of the melted conductor 13 scattering to the inner wall surface 8*a* of the case 3, because the melted conductor 13 is deposited on the surface 11*a* side and not deposited on the other surface 11*b*, the melted conductor is not continuously deposited on the inner wall surface 8*a* spanning between the lead-out ports 7, 7, which can prevent the occurrence of a short-circuit between both ends of the blown out fuse element 2.

Furthermore, the projecting section 16 is provided from the blowout location 12 of the fuse element 2 to the lead-out port 7 and projects towards the upper side of the case 3 which is perpendicular to the direction of current flow. Thus, within the housing space 8, the projecting section protrudes from the blowout location 12 of the fuse element, and at least a portion of the inner wall surface 8*a* of the enclosure 5 between the lead-out ports 7, 7 of the case 3 are blocked by portions of the projecting section 16 shielded from the blowout location 12.

By doing this, as illustrated in FIG. 11, the projecting section protrudes from the blowout location of the fuse element 2, and because the inner wall surface 8*a* of the enclosure therebehind is blocked and shielded from the blowout location 12 by the projecting section 16, the fuse element 2 melts and, even in the case of the melted conductor 13 scattering towards the inner wall surface 8*a* of the case 3, the melted conductor 13 is deposited on the projecting section 16 and is not deposited on areas of the inner wall surface 8 blocked thereby. Therefore, the projecting section 16 prevents the melted conductor 13 from being continuously deposited on the inner wall surface 8*a* spanning between the lead-out ports 7, 7 and prevents a state in which both ends of the blown out fuse element 2 are short-circuited by the melted conductor 13 being continuously deposited on the inner wall surface 8*a* of the enclosure 5 spanning between the lead-out ports 7, 7.

Fuse Element Structure

As mentioned in the above, the fuse element 2 of the fuse device 1 is formed as a laminated structure having an inner and an outer layer, and a structure can be used in which the low melting point metal layer 2*a*, as the inner layer, is covered by the outer layer comprising the high melting point metal layer 2*b* (FIG. 2 (B)). The fuse element 2 can be manufactured by using plating techniques to deposit the high melting point metal layer 2*b* on the surface of the low melting point metal layer 2*a*. For example, the fuse element 2 can be efficiently manufactured by plating Ag to a long solder foil in which, by cutting according to size at the time of use, the low melting point metal layer 2*a*, surrounded by the high melting point metal layer 2*b*, is exposed on the cut surface.

Figure 12:
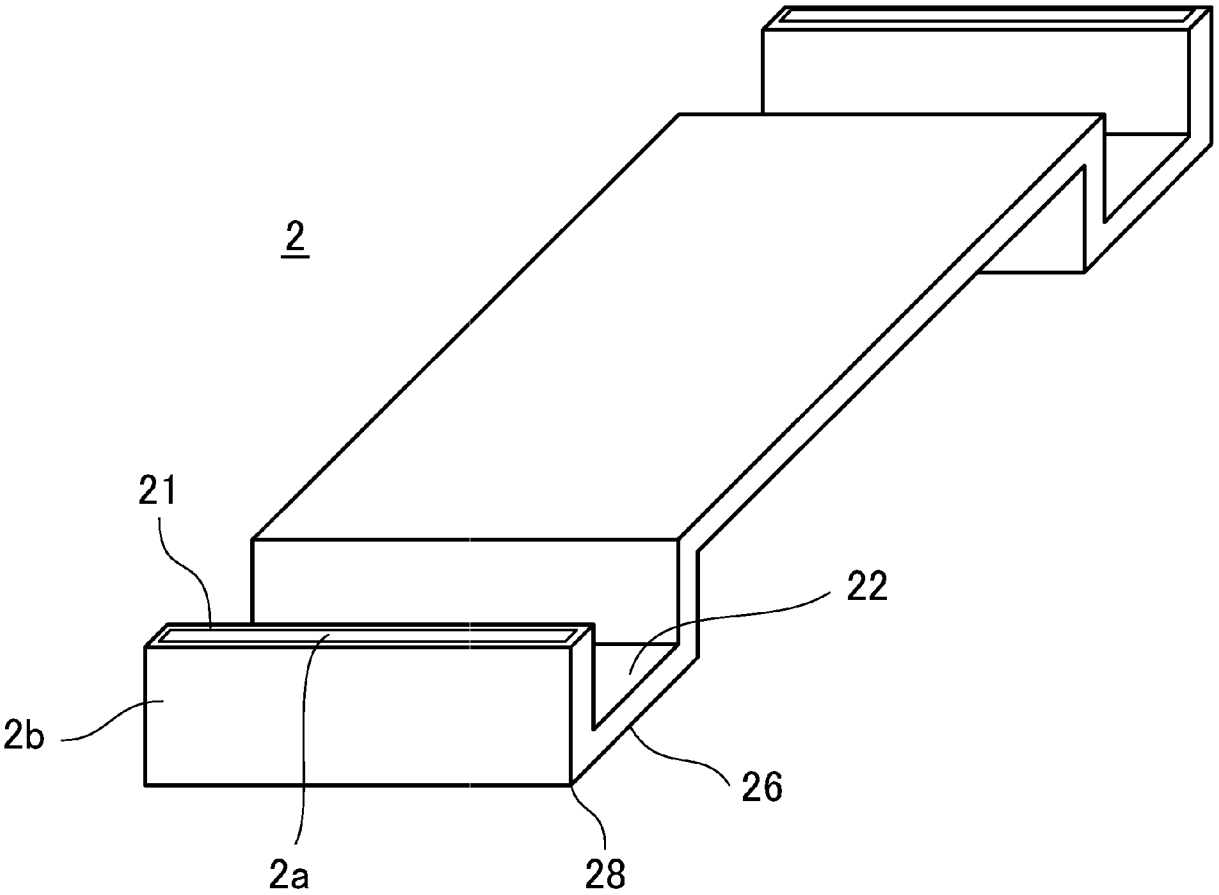
FIG. 12 is a perspective view illustrating an alternative structure of a fuse element according to the present invention.
Figure 13:
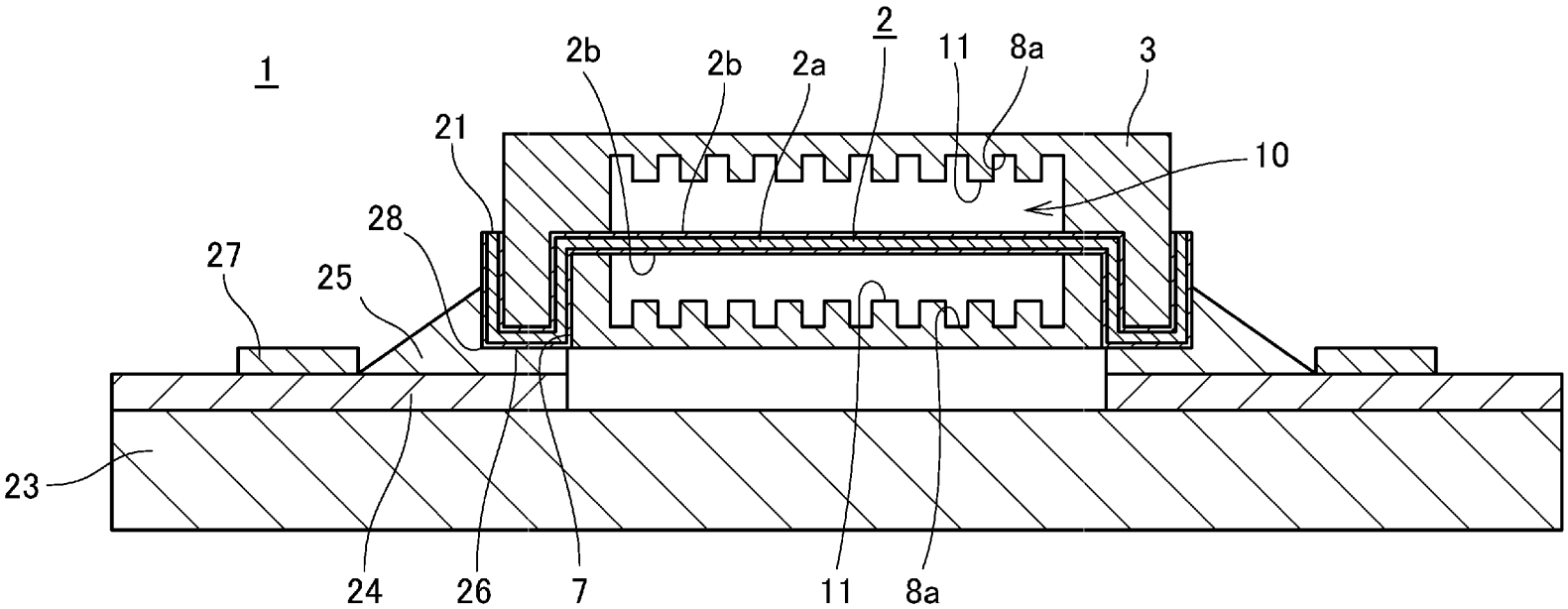
FIG. 13 is a cross-sectional view illustrating a fuse device using the fuse element illustrated in FIG. 12.

As illustrated in FIG. 12, in such a structure having the low melting point metal layer 2*a* covered by the high melting point metal layer 2*b*, the fuse element has an edge surface 21 in which the low melting point metal layer is exposed and an edge portion having the edge surface 21 is used as a terminal 22 for connecting to an external circuit. As illustrated in FIG. 13, when the fuse element 2 is housed in the case 3, the terminal 22 is led out to the exterior via the lead-out port 7. Furthermore, the terminal 22 has a connecting section 26 for connecting to a land 24 of a printed substrate 23, to which the fuse device 1 is mounted, using a bonding material 25 such as solder. In addition, the land 24 has a solder resist layer 27 formed thereon.

Furthermore, in the terminal 22, the edge surface 21 protrudes from the connecting section 26. In so doing, in the fuse element 2, even in the case of the connecting section 26 being connected to the land 24, contact with the bonding material 25 of the edge surface 21 is prevented. Therefore, when the fuse device 1 is thermally mounted to the printed substrate 23, such as by using reflow, the exposed low melting point metal layer 2*a* on the edge surface 21 is drawn in by contacting the melted bonding material 25 and thereby can be prevented from leaking.

Figure 14:
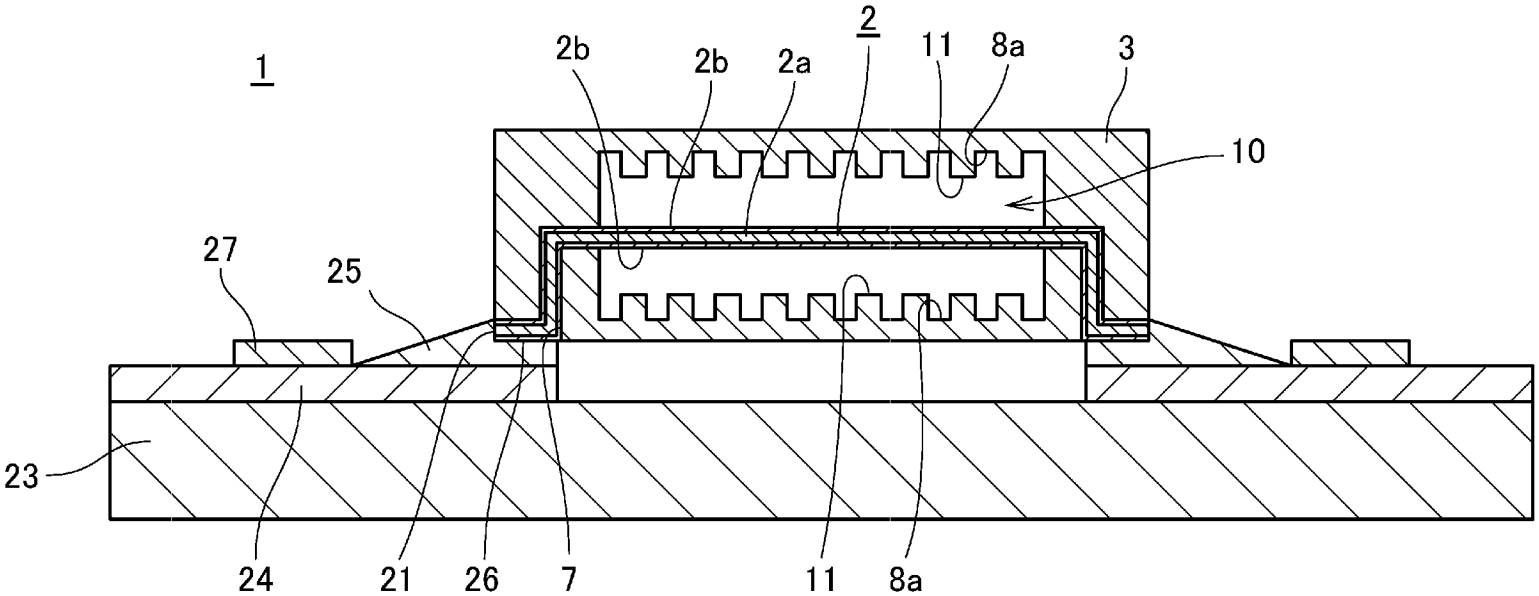
FIG. 14 is a cross-sectional view illustrating a fuse device relating to a reference example.

Thus, because the fuse element 2, being formed in an elongated shape, is cut to a predetermined length, the inner layer of the low melting point metal layer 2*a* is exposed on the edge surface 21. Therefore, because the low melting point metal layer 2*a* melts when the fuse device 1 is thermally mounted, as illustrated in FIG. 14, when the low melting point metal layer 2*a* contacts the bonding material 25, likewise being melted, the low melting point metal layer 2*a* is drawn onto the land 24, which has an excellent wetting property, and might leak from inside of the fuse element 2. If the low melting point metal of the layer 2*a* leaks, the shape of the fuse element 2 cannot be maintained, reduced cross-sectional area causes resistance to increase and the rating to fluctuate, and blowout properties and electrical insulation when the circuit is interrupted might be degraded.

Accordingly, in the fuse element 2, by the edge surface 21 protruding from the connecting section 26 which connects to the land 24 via the bonding material 25, the low melting point metal layer 2*a* does not contact the bonding material 25 thereby preventing low melting point metal leakage. This prevents shape change and maintains the predetermined rating, blowout properties and electrical insulation.

The edge surface 21 of the terminal 22 may be made to protrude from the connecting section 26 by bending the fuse element 2 at least one time. By bending the edge surface 21 at least once from the connecting section 26, even in the case of the connecting section 26 being connected to the land 24, the low melting point metal layer 2*a* can be prevented from contacting the bonding material 25; furthermore, even in the case of the bonding material 25 extending across the terminal 22 to the edge surface 21, leakage of low melting point metal can be suppressed to a minimal amount by a bent section 28.

Figure 15:
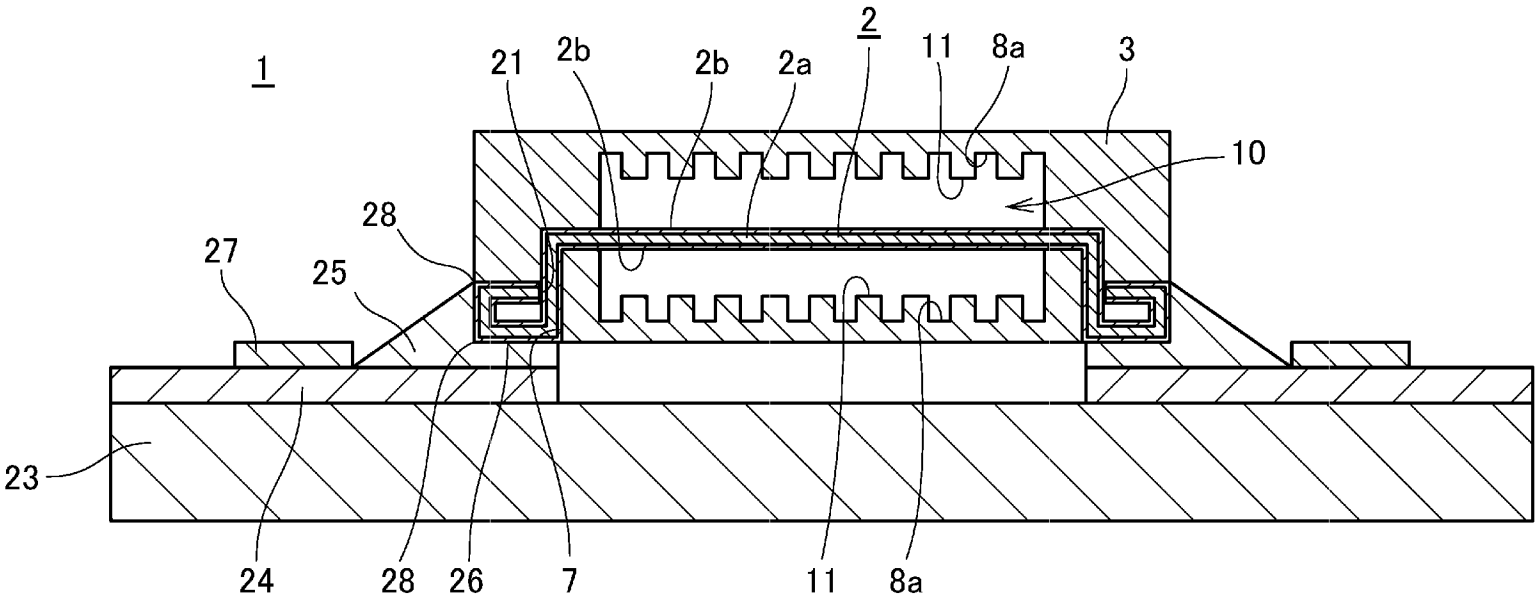
FIG. 15 is a cross-sectional view illustrating a fuse device using a fuse element in which a plurality of bent portions are formed in a connecting section.

In addition, in the fuse element 2, the edge surface 21 may be bent multiple times from the connecting section 26 to separate the edge surface 21 from the bonding material 25. For example, as illustrated in FIG. 15, in the fuse element 2, the edge surface 21 may be bent multiple times from the connecting section 26 to face the housing 5 side of the case 3 to shield from the bonding material 25. Thus, the low melting point metal layer 2*a* exposed on the edge surface 21 can be prevented from contacting the bonding material 25 and leakage of low melting point metal can be prevented.

Figure 16:
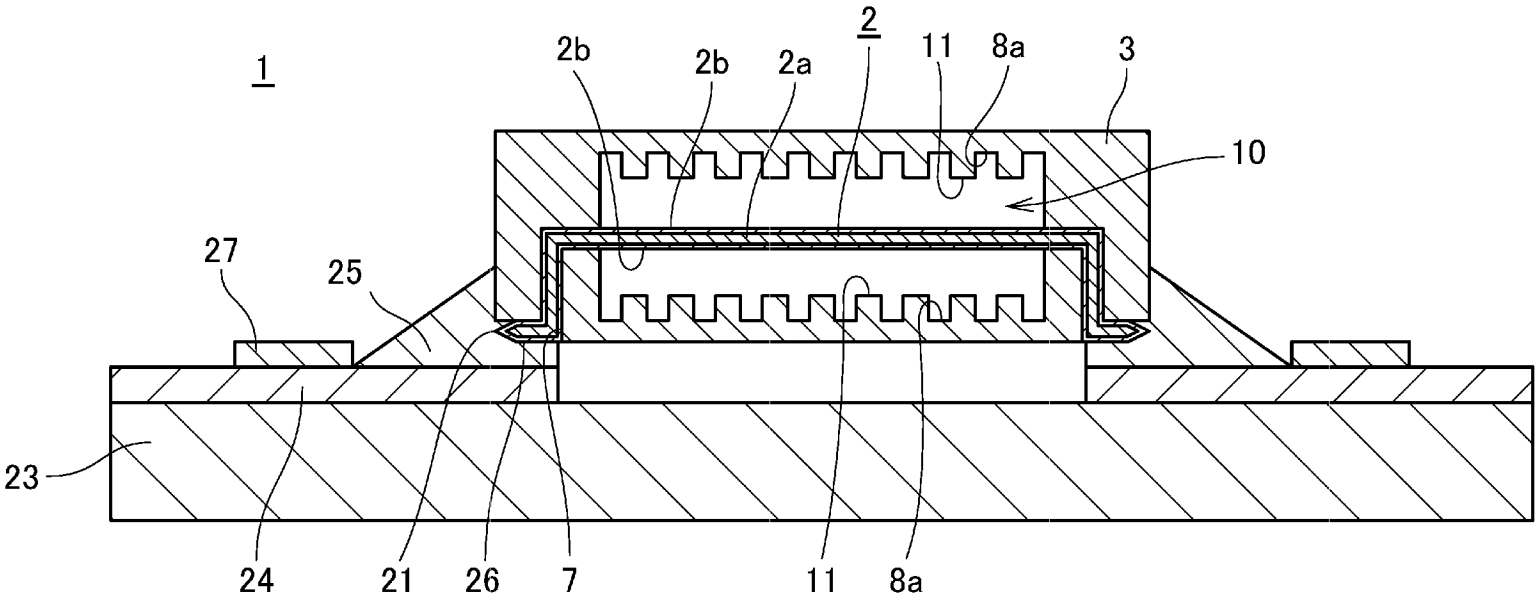
FIG. 16 is a cross-sectional view illustrating a fuse device using a fuse element in which an edge surface is sealed.

Furthermore, in the fuse element 2, as illustrated in FIG. 16, the edge surface 21 of the terminal 22 may be sealed. In the fuse element 2 illustrated in FIG. 16, for example, by thermally compressing the end of the terminal 22, the outer layer composed of the high melting point metal layer 2*b* seals the inner layer composed of the low melting point metal layer 2*a*. The high melting point metal layer 2*b* sealing the edge surface 21, by being fused together at an interface by being pressed at a predetermined temperature and pressure, can reliably prevent leakage of the low melting point metal layer 2*a*. It should be noted that, in the fuse element 2, if the low melting point metal layer 2*a* exposed on the edge surface 21 is sealed in, means for sealing are not limited to thermal compression.

Figure 17:
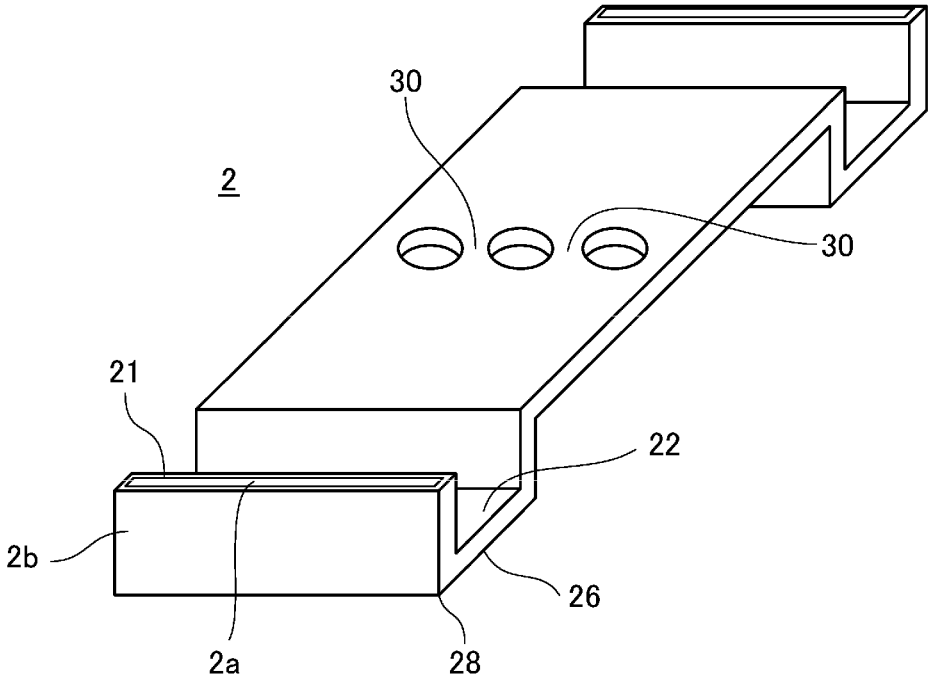
FIG. 17 is a perspective view illustrating a fuse element having a plurality of blowout sections.

It should be noted that, in the fuse element 2, as illustrated in FIG. 17, a blowout section 30 having a reduced cross-section may be formed. By having a reduced cross-sectional area, the blowout section 30 has increased resistance. Therefore, in the fuse element 2, by forming the blowout section 30, a position of a blowout location can be arbitrarily selected.

The blowout section 30 can be formed by, for example, along with forming the fuse element 2 in an approximately rectangular shape, punching out or ablating, among other methods, to remove a portion which is central relative to the longitudinal direction. Furthermore, as illustrated in FIG. 17, the blowout section 30 may be formed in a plurality by punching out the interior of the fuse element 2 or only one of them may be formed by punching out or ablating an edge portion of the fuse element 2.

Figure 18:
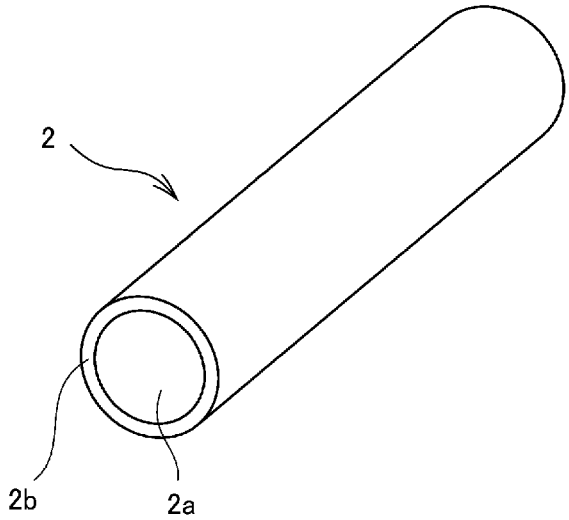
FIG. 18 is a perspective view illustrating a fuse element in a wire-like form.
Figure 19A:
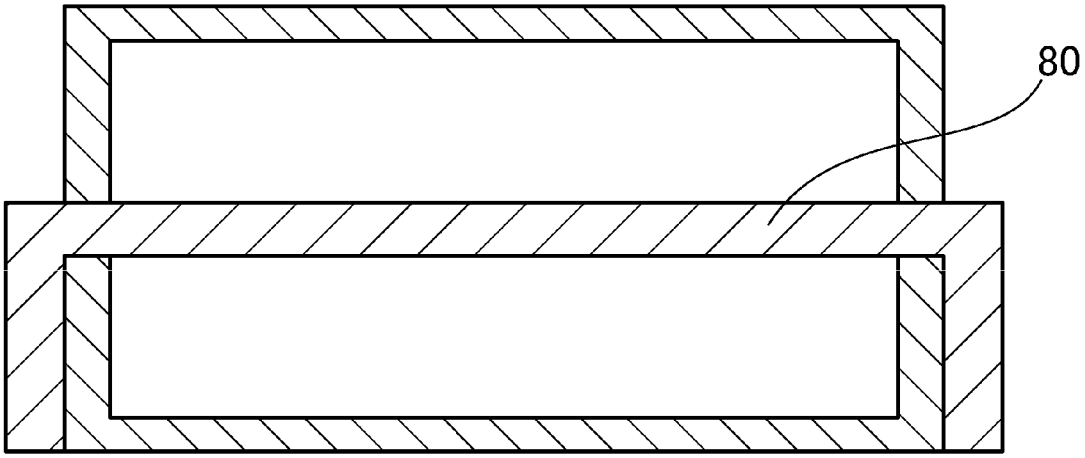
FIG. 19 is a cross-sectional view illustrating a fuse device (A) before melting of the meltable conductor and (B) after melting of the meltable conductor.
Figure 19B:
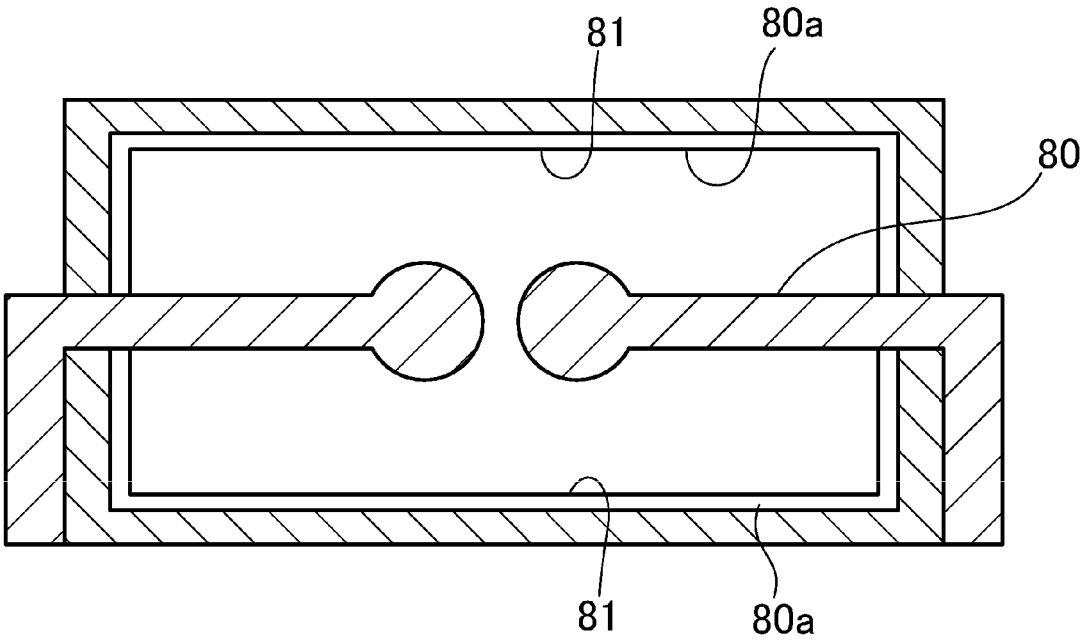

The fuse element 2, other than the plate shape, may also be formed in a wire-like shape, as illustrated in FIG. 18. A fuse element 2 in a wire-like shape, for example, can be efficiently manufactured by using such methods as electroplating to form an Ag plating onto a wire solder. In the fuse element 2 having a wire-like shape, as well, leakage of the wire solder can be prevented by the terminal 22 being formed to protrude from the connecting section 26 and being bent from the connecting section 26 or by sealing in the edge surface 21. Additionally, the blowout section 30 can be formed in the fuse element 2 having a wire-like shape by crimping a portion thereof to reduce cross-sectional area.

REFERENCE SIGNS LIST

1 fuse device, 2 fuse element, 2*a* low melting point metal layer, 2*b* high melting point metal layer, 3 case, 5 enclosure, 6 cover, 7 lead-out port, 8 housing space, 10 shield, 11 projection, 12 blowout location, 13 melted conductor, 16 projecting section, 21 edge surface, 22 terminal, 23 printed substrate, 24 land, 25 bonding material, 26 connecting section, 27 solder resist layer, 28 bent section, 30 blowout section

The invention claimed is:

1. A fuse device comprising:

a fuse element;

a case having a housing space for housing a blowout section of the fuse element and having lead-out ports through which first and second ends of the fuse element are led out, the case supporting the fuse element in a bridge-like manner in the housing space;

a shield disposed in the housing space for shielding an inner wall surface leading to the lead-out ports from a scattered melted material of the fuse element, wherein the shield is a projection including a plurality of projections projected from an inner wall surface of the housing space orthogonal to a current flowing direction of the fuse element, the fuse element has an inner layer which is a low melting point metal layer and an outer layer which is a high melting point metal layer, and the high melting point metal layer comprises silver or an alloy containing silver as a main component; and an edge surface on which the low melting point metal is exposed and which has an edge portion as a terminal for connecting to an external circuit.

2. The fuse device according to claim 1, wherein the projection is continuously or non-continuously formed over the entire surface of the inner wall surface surrounding the entire perimeter of the fuse element.

3. The fuse device according to claim 1, wherein the projection is provided in the vicinity of the lead-out ports.

4. The fuse device according to claim 1, wherein the plurality of the projections are arranged to face each other.

5. A fuse device comprising:

a fuse element;

a case having a housing space for housing a blowout section of the fuse element and having lead-out ports through which first and second ends of the fuse element are led out, the case supporting the fuse element in a bridge-like manner in the housing space; and a shield disposed in the housing space for shielding an inner wall surface leading to the lead-out ports from a scattered melted material of the fuse element, wherein the shield is a projecting section provided on the fuse element and projects from a blowout location of the fuse element towards a surface side of the inner wall surface of the housing space perpendicular to a direction of current flow, the projecting section protrudes towards the inner wall surface supporting the fuse element in a bridge-like manner in the housing space, is not in contact with the inner wall surface in the housing space, and is formed over an entire perimeter of the fuse element, and the projecting section is formed at a position separated from the blowout section on first and second sides of the blowout section.

6. The fuse device according to claim 5, wherein the projecting section is continuously formed to surround the entire perimeter of the fuse element.

7. The fuse device according to claim 5, wherein the fuse element has an inner layer which is a low melting point metal layer and an outer layer which is a high melting point metal layer.

8. The fuse device according to claim 5, wherein the projecting section is provided in the vicinity of the lead-out ports.

9. The fuse device according to claim 5, wherein a plurality of the projecting sections are formed on the fusible element.

10. A fuse device comprising:

a fuse element;

a case having a housing space for housing a blowout section of the fuse element and having lead-out ports through which first and second ends of the fuse element are led out, the case supporting the fuse element in a bridge-like manner in the housing space; and a shield disposed in the housing space for shielding an inner wall surface leading to the lead-out ports from a scattered melted material of the fuse element, wherein the shield is a projection projected from an inner wall surface of the housing space orthogonal to a current flowing direction of the fuse element, and a projecting section provided on the fuse element and projects from a blowout location of the fuse element towards a surface side of the inner wall surface of the housing space perpendicular to a direction of current flow, the projection is not in contact with the fuse element in the housing space, and is formed over an entire surface of the inner wall surface surrounding an entire perimeter of the fuse element, the projecting section projects towards the inner wall surface supporting the fuse element in a bridge-like manner in the housing space, is not in contact with the inner wall surface in the housing space, and is formed over the entire perimeter of the fuse element, and the projection and the projecting section are formed at a position separated from the blowout section on first and second sides of the blowout section.

11. The fuse device according to claim 10, wherein the projection is continuously or non-continuously formed over the entire surface of the inner wall surface surrounding the entire perimeter of the fuse element.

12. The fuse device according to claim 10, wherein the fuse element has an inner layer which is a low melting point metal layer and an outer layer which is a high melting point metal layer.

13. The fuse device according to claim 10, wherein the projection and the projecting section are provided in the vicinity of the lead-out ports.

14. The fuse device according to claim 10, wherein a plurality of the projecting sections are formed on the inner wall surface.

15. A fuse element supported in a bridge-like manner within a housing space in a case and having first and second ends led out of lead-out ports of the case comprising:

a projecting section projecting towards the inner wall surface side that supports the fuse element in a bridge-like manner in the housing space for shielding an inner wall surface of the case leading to the lead-out ports from a scattered melted material of the fuse element, wherein the projecting section is formed over an entire perimeter of the fuse element, and the fuse element has a blowout section, and the projecting section is formed at a position separated from the blowout section on first and second sides of the blowout section.

16. The fuse element according to claim 15, wherein the projecting section is continuously formed to surround the entire perimeter of the fuse element.

17. The fuse element according to claim 15, wherein the projecting section is provided in the vicinity of the lead-out port.

18. The fuse element according to claim 15, wherein a plurality of the projecting sections are formed.

19. The fuse element according to claim 15, wherein the fuse element has an inner layer which is a low melting point metal layer and an outer layer which is a high melting point metal layer.

20. The fuse element according to claim 19, further comprising an edge surface on which the low melting point metal is exposed and which has an edge portion as a terminal for connecting to an external circuit.

21. The fuse element according to claim 20, wherein the terminal has a connecting section which connects to a land of the external circuit and the end surface projects beyond the connecting section.

22. The fuse element according to claim 21, wherein the end surface is bent at least once from the connecting section.

23. The fuse element according to claim 20, wherein the terminal has a connecting section which connects to a land of the external circuit and the end surface is sealed.

24. The fuse device according to claim 7, wherein the first and second ends of the fuse element are connected to a land of an external circuit by a solder, and the melting point of the low melting point metal layer is lower than the temperature of a solder reflow mounting.

25. The fuse device according to claim 12, wherein the first and second ends of the fuse element are connected to a land of an external circuit by a solder, and the melting point of the low melting point metal layer is lower than the temperature of a solder reflow mounting.

26. The fuse element according to claim 19, wherein the first and second ends of the fuse element are connected to a land of an external circuit by a solder, and the melting point of the low melting point metal layer is lower than the temperature of a solder reflow mounting.

27. The fuse element according to claim 1, wherein the plurality of projections include a first group of projections and a second group of projections, and the first group of projections are formed in the housing space without being in contact with the second group of projections.

28. The fuse element according to claim 1, wherein the projection is formed at a position separated from the blowout section of the fuse element.

* * * * *